United States Patent [19]

Eichholz

[11] 3,996,641

[45] Dec. 14, 1976

[54] TIPPING FORCE REDUCING APPARATUS

[75] Inventor: Arthur H. Eichholz, Polo, Ill.

[73] Assignee: Central Quality Industries, Inc., Polo, Ill.

[22] Filed: Apr. 28, 1975

[21] Appl. No.: 572,612

[52] U.S. Cl. ..... 15/339; 15/410

[51] Int. Cl.[2] ..... A47L 9/00

[58] Field of Search ..... 15/327 R, 327 D, 339, 15/352, 353, 410

[56] References Cited

UNITED STATES PATENTS

| | | | |
|---|---|---|---|
| 1,559,804 | 11/1925 | Sweeny | 15/327 R X |
| 2,534,808 | 12/1950 | Bevington, Jr. et al. | 15/327 R X |
| 3,179,442 | 4/1965 | Lofgren | 15/410 X |
| 3,775,951 | 12/1973 | Eichholz et al. | 15/327 D X |

FOREIGN PATENTS OR APPLICATIONS

| | | | |
|---|---|---|---|
| 547,583 | 10/1957 | Canada | 15/327 D |
| 495,179 | 4/1930 | Germany | 15/327 R |

*Primary Examiner*—Christopher K. Moore
*Attorney, Agent, or Firm*—Wegner, Stellman, McCord, Wiles & Wood

[57] ABSTRACT

Apparatus for reducing tipping forces applied to an upright cannister-type vacuum cleaner when pulled by an elongate flexible intake hose connected thereto including an elongate strap, means for releasably connecting one end of the strap to a point on the appliance body to beneath the intake hose connector and means for adjustably attaching the other end of the strap to a portion of the hose spaced from the hose connector. When pulling forces from the user are applied to the vacuum cleaner body through the intake hose while vacuuming is being performed, the strap redirects at least a portion of the pulling forces away from the hose connecting means and to the vacuum cleaner body at the strap connection point. The redirection of the pulling forces both increases the upward directed component thereof to decrease friction opposing rolling motion of the vacuum cleaner body, and reduces the effective moment arm and thus the force moment of the horizontal component of the pulling force tending to tip the apparatus about its base.

11 Claims, 6 Drawing Figures

Fig 1
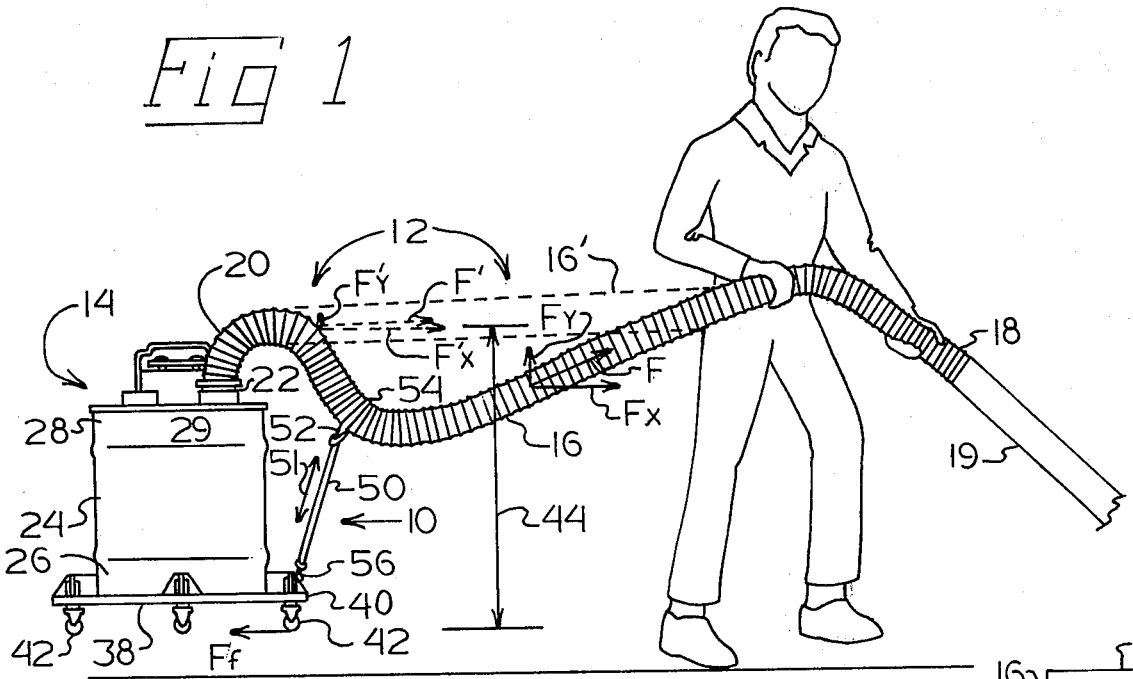
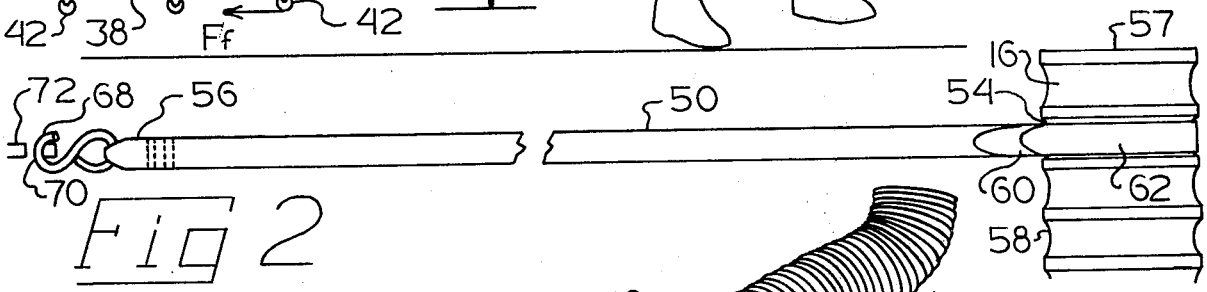
Fig 2
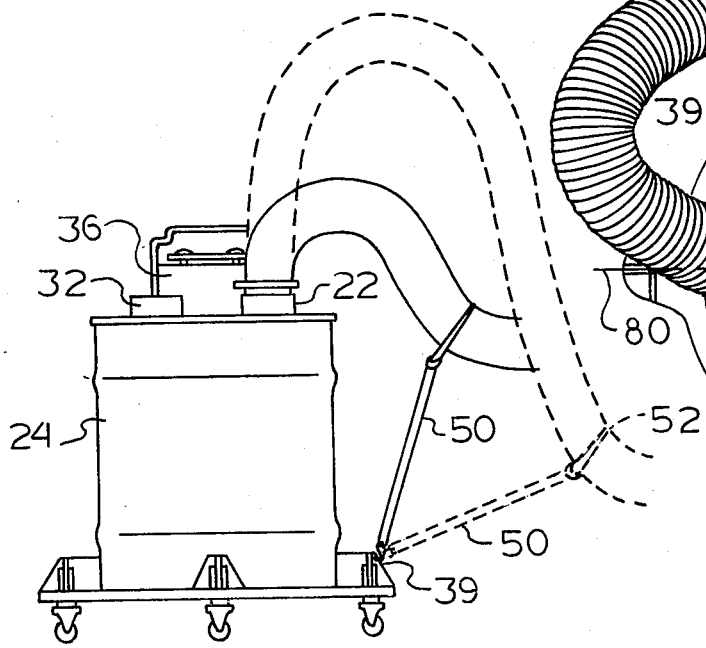
Fig 3
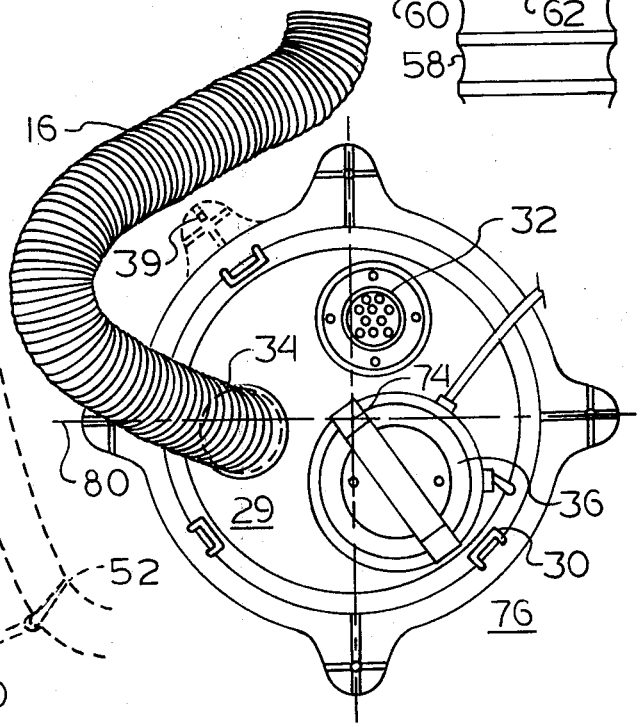
Fig 4

TIPPING FORCE REDUCING APPARATUS

BACKGROUND OF THE INVENTION

The present invention relates to a work performing appliance of the type having means for facilitating movement of the appliance body along a floor surface when pulled by a hose used to perform the work of the appliance and, more particularly, apparatus for distributing the pulling forces applied through the hose to the appliance to reduce the tendency of those forces to tip over the appliance.

The present invention was developed to solve a tipping problem encountered with heavy duty vacuum cleaners of the upright drum or cannister type. Accordingly, the apparatus will be described as used in conjunction with, and the background of the invention will be given with reference to, a vacuum cleaner of this type. It should, however, be appreciated that the apparatus can be successfully employed with other appliances.

Upright drum vacuum cleaners are particularly adapted for drawing heavy or large debris commonly found in garages, workshops, etc. Some of these units are also adapted to vacuum standing water. Elongate, flexible intake hoses are provided to selectively direct the suction forces from a vacuum cleaner body throughout an area around the body. In order to clean an area beyond the reach of the flexible hose, the vacuum cleaner body itself must be moved to another location.

It is known to provide the vacuum cleaner body with a set of casters or the like so that it may be rolled across a floor surface to different areas to be cleaned. With the provision of casters, the vacuum cleaner body is automatically pulled behind the user into a new location as soon as the user, in trying to reach a surface beyond the flexible extent of the hose, applies a pulling force through the hose to the body. Ideally, through this natural vacuuming action of the user and the provision of means to facilitate sliding or rolling motion of the body across a floor surface, the user need not return to the vacuum cleaner body and carry or push it to a new location each time it is desired to clean an area beyond the extent of the hose. This naturally increases efficiency, reduces user work and consequently enhances user satisfaction.

Unfortunately, because of various characteristics of the vacuum cleaner body dictated by functional design requirements, pulling the intake hose frequently tips the vacuum body over on its side, and the advantages otherwise enjoyable through the provision of casters or the like are lost. First, a heavy electric motor is mounted at the top of the upright drum, which makes the vacuum cleaner body top-heavy and unstable when tipped away from its normal vertical orientation. Functional requirements also dictate that the intake opening to which the one end of the intake hose is connected, and thus where the pulling forces are applied, be located adjacent the top of the drum. Each time the vacuum cleaner body is tipped over on its side, the user must of course return to the vacuum cleaner body to put it back in an upright position before work can be resumed. Further, if the drum is filled with water or fluid, like material such as dust, tipping the drum may result in escape of the fluid through the vacuum outlet opening and onto the floor surface being cleaned. As the drum fills with debris, the vacuum body becomes less top-heavy, but the increased weight increases the static friction forces between the floor surface and the casters resisting movement in the direction of pulling forces, and thus the tendency of the vacuum cleaner body to tip is not substantially reduced.

SUMMARY OF THE INVENTION

The principal object of the present invention is to provide apparatus for reducing the tendency of an upright appliance body to tip when pulled by a flexible hose used to perform the work of the appliance which is connected adjacent the top of the appliance body.

This objective is achieved in the preferred embodiment of the tip reducing apparatus by means of an elongate flexible member or strap connected to the appliance body at a point adjacent its base at one end thereof and connected to a portion of the flexible hose spaced from the end of the hose connected to the appliance body. The flexible strap redirects at least a portion of the pulling forces from the hose away from the hose connecting means adjacent the top and to the appliance body at the point adjacent the base beneath the hose connecting means. The flexible strap is of a length to prevent the spaced hose portion from movement above the hose connecting means to increase the vertical component of the total force applied through the hose to the appliance body. Increasing the vertical component reduces the frictional forces opposing rolling motion of the body in the direction of the horizontal force component. The strap also functions to redistribute the horizontal force component along the length of the body to reduce the total horizontal force moment tending to tip the body.

An important feature of the tip prevention apparatus is that it may be effectively used with an appliance having an intake hose connector which allows rotary motion of the end of the hose about a vertical axis normal to the top cover of the drum so that the user may swivel the hose 360° around the vacuum cleaner body for improved maneuverability of the hose relative to the body. The swivel feature may be used to a limited extent even when the tip prevention apparatus is operatively connected to the appliance.

Other advantageous features of the tip reducing apparatus of the present invention include the provision of means for facilitating adjustments to the connection point of the appliance body, the length of the strap, and the location along the length of the hose at which the strap is connected as the condition of floor surfaces and loading may require.

The foregoing features and advantages will be discussed in more detail, and further features and advantages will be made apparent in the following description of the preferred embodiment taken in conjunction with the following drawing.

BRIEF DESCRIPTION OF THE DRAWING

The description of the preferred embodiment is given with reference to the following drawing in which:

FIG. 1 is a side view of the tip reducing apparatus as employed with an upright cannister, heavy-duty, vacuum cleaner;

FIG. 2 is an enlarged view of the strap shown in FIG. 1, and illustrating the manner in which it is connected to the flexible hose;

FIG. 3 is a side view of a vacuum cleaner utilizing the tip reducing apparatus and illustrating the effect of connecting the strap at different points along the length of the hose.

FIG. 4 is a top view of the vacuum cleaner of FIGS. 1 and 2 employing the tip preventing apparatus and illustrating the manner in which the connection point of the strap to the appliance body may be adjusted relative to lateral location of the center of gravity of the appliance;

DESCRIPTION OF THE PREFERRED EMBODIMENT

Figure 5B:
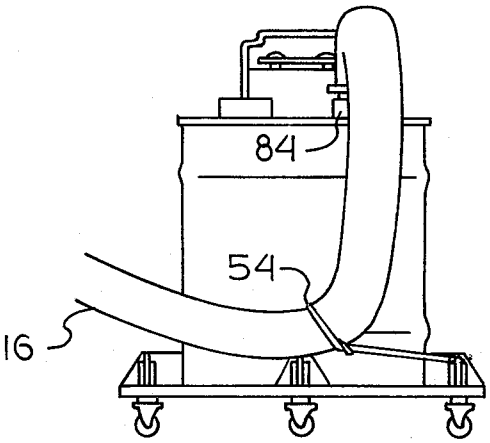
FIG. 5B is a side view of a vacuum cleaner employing the tip reducing apparatus and illustrating the cooperation thereof with a swivel feature of the vacuum cleaner.

Referring to FIG. 1 of the drawing, the tip reducing apparatus 10 is seen as used on an upright drum or cannister-type vacuum cleaner 12. Upright vacuum cleaner 12 includes a body 14 and an elongate flexible intake hose 16. Intake hose 16 has a free end 18 carried by the user when vacuuming to which may be attached a rigid tubular wand 19. Different nozzles (not shown) are attachable to the end of the wand for different vacuuming jobs. The other end 20 of intake hose 16 is operatively connected to an intake opening in body 14 by means of a suitable intake hose connector assembly 22.

The vacuum cleaner body includes an upright elongate cylindrical drum or cannister 24 having a base 26 and a top 28. The top 28 is closed by a cover or lid 29 that is held to the drum 24 by a plurality of releasable fasteners 30, as best seen in FIG. 4. The cover 29 has an outlet opening 32 and an intake opening 34 axially located within hose connector assembly 22. Cover 29 carries an electric motor assembly 36 on the outside of the drum and a manifold assembly and filter assembly (not shown) on the under surface thereof within the drum, all of which render the body 14 top-heavy. The vacuum cleaner body also includes a caster assembly 38 carried by drum 24 adjacent base 26 to facilitate movement of the vacuum cleaner body 14 across a floor surface when hose 16 is pulled by the user. Caster assembly 38 comprises a frame 40 releasably attachable and rotatable relative to the drum beneath base 26 and a plurality of casters 42 mounted to the frame.

In the absence of the tip reducing apparatus 10 of the present invention, hose 16 extends in a substantially straight line from adjacent end 20 to the user's hands when being pulled, as indicated by the broken line representation 16' of the hose seen in FIG. 1. The total pulling force F' exerted by the user is directed from end 20 of hose 16' to the user in a substantially straight line along the length of the hose segment 16'. Thus, substantially all of the total pulling force F' is directed horizontally as indicated by the broken line horizontal force vector $F'_x$. The total force F' has only a very small vertical component $F'_y$.

Due to friction between the floor surface and casters 42, a horizontally directed static friction force $F_f$ is developed at the junction between the floor surface and the casters which opposes motion of the vacuum cleaner body 14 in the direction of the horizontal pulling force component $F'_x$. The maximum magnitude of the friction force $F_f$ is equal to the product of the coefficient of friction between the floor surface and the casters 42 and the normal force N that is applied thereto. The normal force N is equal to the weight of vacuum cleaner body 14 decreased by the magnitude of the vertical component $F'_y$ of the pulling force. The static frictional force is a reactive force which equals the horizontal component $F'_x$ of the pulling force F' until the horizontal force component $F'_x$ exceeds the maximum magnitude of frictional force $F_f$ and rolling motion ensues. The vacuum cleaner body 14 remains stationary and does not begin to roll across the floor surface until after the horizontal pulling force component exceeds the maximum frictional force $F_f$.

Accordingly, a force moment is developed that tends to tip or pivot the vacuum cleaner body 14 about the leading caster 42' before rolling motion begins. The force moment is equal to the product of the horizontal force component $F'_x$ and its moment arm 44. Moment arm 44 is equal to the distance between the floor surface and the level at which the horizontal force component $F'_x$ is applied to the vacuum cleaner body 14. If the frictional forces holding the base 26 stationary are not overcome before the force moment increases to a magnitude sufficient to pivot the vacuum cleaner body 14, the body 14 will tip. Due to the high vertical location of its center of gravity, the body is placed in an unstable position when tipped only a small amount and will topple on its side. If the frictional forces are overcome before tipping, the body 14 will of course roll across the floor surface as desired. Thus, it is seen that, whether the vacuum cleaner body 14 tips upon the application of a given pulling force depends upon factors including both the magnitude of the frictional force and the magnitude of the force moment developed by the horizontal component of the pulling force.

The tip reducing apparatus 10 functions to alter both of these factors to reduce the tendency of the pulling forces applied through the hose 16 to tip the vacuum cleaner body 14. This is achieved by redirecting at least a portion of the pulling forces applied through hose 16 away from the hose connecting means 22 and to the vacuum cleaner body 14 at point 39 beneath the hose connecting means. The preferred embodiment of the tip reducing apparatus 10 comprises an elongate flexible member or strap 50, means for attaching a part of the strap at one of its ends 52 to a portion 54 of the elongate hose 16, and means for connecting the other one of its ends 56 to point 39 on frame 40 adjacent base 26. The portion 54 of intake hose 16 is spaced from the intake hose connector 22. Preferably, the strap 50 is of a length to restrain portion 54 of hose 16 from moving to a level above the intake hose connector 22. By lowering the maximum level to which portion 54 can rise, the magnitude of the vertical component $F_y$ relative to the horizontal component $F_x$ of the total pulling force F is increased, as illustrated in FIG. 1. While a small portion of the total force may be applied to the appliance adjacent top 28 through the length of flexible hose between hose connector 22 and portion 54, a substantial portion of force F is directed along the length of strap 50 to the connection point on caster assembly 38 as indicated by double-headed arrow 51 in FIG. 1. Thus, the increased vertical component reduces the frictional force $F_f$ opposing forward motion of the appliance and the effective moment arm of a portion of the horizontal force component $F_x$ is decreased, thereby reducing the force moment tending to tip the vacuum cleaner body 14.

It should be appreciated that a rigid member could be utilized in place of flexible strap 50. If a rigid member is utilized in place of flexible strap 50, it may be connected at any point on the appliance so long as the portion 54 of the intake hose is held to a level beneath hose coupler 22. If the elongate member 50 is flexible, as described, then the connection point 39 on the appliance must be located beneath the hose connector 22 in order to direct the pulling forces to a point beneath the hose connecting means. When utilizing a flexible strap, a portion of the total pulling force F is applied to the vacuum cleaner body at the end 56 of the strap even when spaced portion 54 of flexible hose 16 is not held to a level beneath hose coupler 22, and thus holding portion 54 to such a level is not absolutely necessary for successful operation.

Referring to FIG. 2, hose 16 is composed of a plurality of relatively rigid spaced ribs with adjacent ribs respectively interconnected by a plurality of flexible webs 58. The ribs 57 provide structural strength to the hose while the webs 58, being resiliently flexible, render the hose resiliently elastic along its length. The hose connecting means includes a loop 60 at end 52 and a length 62 of strap 50 wound around one of the webs 58 and through loop 60. This forms a second loop of course which tightens around the web 58 of the spaced portion 54 when a pulling force is applied to strap 50. The width dimension of strap 50 is selected in accordance with the spacing between ribs 57, such that the second loop that is formed nestles between a pair of adjacent ribs and is held thereby against movement along the length of the hose 16.

The loop 62 of strap 50 provides a means for easily adjusting the location of the spaced portion 54 of hose 16. Accordingly, the adjustable connection to the hose provides a simple and easy means to alter the force distribution achieved by tip reducing apparatus 10. As seen in FIG. 3, as the distance between the hose connector 22 and the spaced portion 54 along the length of hose 16 is increased, the level to which portion 54 may rise when pulling forces are applied during normal operation is lowered. This alters both the direction of the total force F through the hose 16 and the direction of the portion of the total force applied through strap 50. The portion of the total pulling force F applied to connector 22 through the length of hose 16 between connector 22 and spaced portion 54 is also decreased when this length is increased due to the increased amount of slack therealong. By providing slack in this length of the hose, the pulling force applied before strap 50 is taut results in removing the slack, i.e., straightening the hose, rather than applying a force to hose connector 22 which might tip the body 14. The force distribution may also be altered by changing the length of strap 50. The loop 60 used to attach the strap 50 to hose 16 also provides a simple way to selectively change the effective length. The effective length may be shortened simply by increasing the number of times that length 62 is wound around hose 16 before being threaded through loop 60. Thus, the releasable and adjustable connection to hose 16 provides an easy means for the operator to adjust the force distribution system provided thereby as desired.

Referring again to FIG. 2, the means connecting end 56 of strap 50 to the vacuum cleaner body 14 includes a hook 68 secured to end 56 of strap 50 and a hook opening 70 for receiving hook 68 contained within a vertical spline member 72 of caster assembly 38. Thus, the strap 50 may be readily disconnected from the appliance when desired, as when the drum 24 is detached from the caster assembly 38 for stationary operation.

Referring now to FIG. 4, when motor 36 is located other than at the geometric center 74, the center of gravity of vacuum cleaner body 14 is located in one quadrant 76 of four quadrants defined by intersecting centerlines 78 and 80. Further reducing the tendency of the vacuum cleaner body to tip when pulled, a connection point 39, in addition to being located beneath hose coupler 22, is located in one of the three remaining quadrants without quadrant 76. Connection of strap 50 to vacuum cleaner body 14 in this manner increases the amount that body 14 must be pivoted before toppling on its side when pulled in a direction directly away from motor 36.

This also reduces the tendency of the vacuum cleaner body 14 to tip when the hose is pulled in a direction generally toward the motor 36 and the center of gravity. When the hose is pulled in this direction, tangential forces are applied through member 50 to body 14 which cause it to rotate about its center of gravity. By keeping the connection pont 39 spaced from the center of gravity as much as possible, the moment arm of the tangential force moment is maximized.

Desirably, at least one of cover 29 and caster assembly 38 may be rotatably adjusted relative to drum 24 to allow adjustment of the connection point 39 relative to the center of gravity. It has been found that location of the connection point 39 directly opposite hose connector 22, as shown in FIGS. 1 and 2, is suitable in most applications. However, maximum tip reducing effect is achieved when connection point 39 is located directly opposite motor 36, as indicated in broken line in FIG. 4.

Figure 5A:
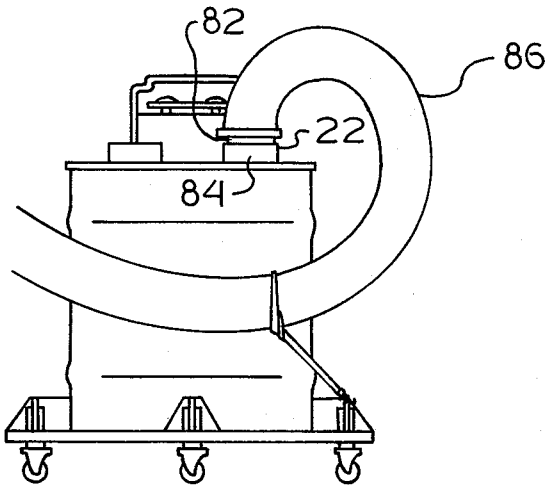
FIG. 5A is a side view of the tip reducing apparatus used on a vacuum cleaner not having a swivel feature.

Referring to FIGS. 5A and 5B, it is seen that the flexible characteristic of strap 50 permits cooperation with a swivel feature of the connector 22. Hose connector 22 comprises a male member 80 connected to the end 20 of hose 16 and a female connector 84 carried by lid 29 and extending in a vertical direction normal thereto. Referring first to FIG. 5A, when the connector 22 is not permitted to rotate, a substantial amount of slack 86 is developed in a direction opposite to the direction that the hose is being pulled. This reduces the effective length of the hose when the vacuum cleaner body is in a location in which it is restrained from rotating in response to the force. Referring to FIG. 5B which illustrates operation when a hose connector 22 allows rotary motion of the end of hose 16, it is seen that the spaced portion 54 of the hose is allowed thereby to move a further distance toward the direction from which the pulling force is applied. Thus, the effective length of hose 16 is limited by strap 50 to a lesser extent when the swivel feature is provided as shown in FIG. 5B.

While a preferred embodiment of the tip reducing apparatus 10 has been shown and described, it should be appreciated that many modifications may be made to the structure which are still within the scope of the invention as defined in the appended claims. For example, while the use of a flexible strap in cooperation with a hose connector 22 having a swivel feature provides a unique advantage, other advantages of the invention could still be enjoyed with a rigid member used in place of strap 50. Likewise, while the loop 60 at the end 52 of the strap 50 in conjunction with the rib and web structure of hose 16 provides a most effective, simple and inexpensive manner of connecting the strap to the hose, if a different type hose were utilized a different means for connecting the strap thereto might be required.

I claim:

1. In a work performing appliance having an upright body with a base and a top, a flexible elongate hose connected to, and used to perform the work of, the appliance, and means carried by the body adjacent the base for facilitating movement of the body along a floor surface when pulling forces through the hose are applied thereto, at least a portion of said pulling forces tending to tip the appliance about its base, apparatus for reducing said tipping force comprising: means for connecting one end of the hose to the top for relative rotary motion therebetween; a member having first and second parts for transmitting forces therebetween, said member being flexible for allowing lateral movement of the spaced portion of the hose relative to the hose connecting means and thereby allowing said rotary motion; means for attaching said first part to a portion of the elongate hose spaced from the hose connecting means; and means for positioning the second part of the member to redirect at least a portion of said pulling forces through the hose away from the hose connecting means and to a point below the level of the hose connecting means, said member being of a length so as to prevent the spaced hose portion from movement above said the level of said hose connecting means at all times.

2. The appliance of claim 1 wherein the spacing between said first and second parts of said member is no greater than substantially the vertical spacing between said connecting means and said point.

3. In a work performing appliance having an upright body with a base and a top, a flexible elongate hose connected to, and used to perform the work of, the appliance, and means carried by the body adjacent the base for facilitating movement of the body along a floor surface when pulling forces through the hose are applied thereto, at least a portion of said pulling forces tending to tip the appliance about its base, apparatus for reducing said tipping force comprising: means for connecting one end of the hose to the top for relative rotary motion therebetween; a member having first and second parts for transmitting forces therebetween, said member being flexible for allowing lateral movement of the spaced portion of the hose relative to the hose connecting means and thereby allowing said rotary motion; means for attaching said first part to a portion of the elongate hose spaced from the hose connecting means; and means for positioning the second part of the member to redirect at least a portion of said pulling forces through the hose away from the hose connecting means and to a point below the level of the hose connecting means, the length of the flexible member being less than the vertical distance between the hose connecting means and the connection point on the appliance body whereby the spaced portion of the hose is prevented from movement above the hose connecting means at all times but is of sufficient length to allow substantial rotary movement of said one end of the hose.

4. In a work performing appliance having an upright body with a base, a flexible elongate hose used to perform the work of the appliance, means operatively connecting one end of the hose to the body above the base, and means carried by the body adjacent the base for facilitating movement of the body along a floor surface when pulling forces through the hose are applied thereto, at least a portion of said pulling forces tending to tip the appliance about its base, apparatus for reducing said tipping forces, comprising:

a member having first and second parts for transmitting forces therebetween;

means for attaching said first part to a portion of the elongate hose spaced from the hose connecting means; and means for connecting the second part of the member to the appliance body, said member redirecting at least a portion of said pulling forces through the hose away from the hose connecting means and to the appliance body at a point beneath the hose connecting means;

said appliance body having a center of gravity spaced from its geometric center within a quadrant thereof, and said point on the appliance body to which the pulling forces are directed by said member being located without said quadrant.

5. The appliance of claim 4 including means for adjustably positioning said point relative to the center of gravity and the hose connecting means.

6. In a work performing appliance having an upright body with a base, a flexible elongate hose used to perform the work of the appliance, means operatively connecting one end of the hose to the body above the base, and means carried by the body adjacent the base for facilitating movement of the body along a floor surface when pulling forces through the hose are applied thereto, at least a portion of said pulling forces tending to tip the appliance about its base, apparatus for reducing said tipping forces, comprising:

an elongate flexible strap having opposite ends;

means for attaching one of said ends to a portion of the hose spaced from the hose connecting means including a closed loop at one of said ends of the strap and a portion of strap between the opposite ends thereof extending through the loop and around the spaced portion of the hose; and means for connecting the other end of the strap to the appliance body including a hook member carried by the other end of the strap and means carried by the appliance body having an opening therethrough for releasably receiving said hook member, said strap redirecting at least a portion of said pulling forces through the hose away from the hose connecting means and to the appliance body at a point beneath the hose connecting means.

7. The apparatus of claim 6 wherein said hose has a plurality of spaced ribs along its length, and the width of the loop and the portion of the strap extending around the hose and through the loop are of a dimension sufficiently small relative to the spacing between the ribs to allow the loop to nestle between a pair of adjacent ribs, said pair of ribs restraining the loop from moving along the length of the hose.

8. In a work performing appliance having an upright body with a base, a flexible elongate hose used to perform the work of the appliance, means operatively connecting one end of the hose to the body above the base, and means carried by the body adjacent the base for facilitating movement of the body along a floor surface when pulling forces through the hose are applied thereto, at least a portion of said pulling forces tending to tip the appliance about its base, apparatus for reducing said tipping forces, comprising:

an elongate flexible member having a pair of opposite ends;

means for attaching one of said ends to a portion of the hose spaced from the hose connecting means including a closed loop at said one end of the member and a section of the member intermediate the opposite ends extending through the loop and around said portion of the hose; and means for releasably connecting the other end of the member to the appliance body beneath the hose connecting means, said member redirecting at least a portion of said pulling forces through the hose away from the hose connecting means and to the appliance body at a point beneath the hose connecting means.

9. The appliance of claim 8 in which said releasably connecting means includes a hook member carried by the other end of the elongate flexible member and means connected with the appliance body for releasable connection with the hook member.

10. The appliance of claim 8 in which said movement facilitating means includes a frame member on which said body is releasably mounted, and said releasably connecting means includes means for coupling said other end of the flexible member to said body through said frame member.

11. The appliance of claim 8 in which said hose has a plurality of spaced ribs along its length and the width of the loop and the section of the elongate flexible member extending around the hose and through the loop are of a dimension sufficiently small relative to the spacing between the ribs to allow the loop to nestle between a pair of adjacent ribs, said pair of ribs restraining the loop from moving along the length of the hose.

* * * * *